United States Patent [19]

Uno

[11] Patent Number: 4,647,265

[45] Date of Patent: Mar. 3, 1987

[54] PAPER SHEET MANIPULATOR

[76] Inventor: Tadao Uno, 1-81, Matsugaoka 1-chome, Chigasaki-shi, Kanagawa-ken, Japan

[21] Appl. No.: 752,729

[22] Filed: Jul. 8, 1985

[51] Int. Cl.[4] ..... B65H 29/34

[52] U.S. Cl. ..... 414/115; 271/189; 271/218; 271/220; 271/3.1; 414/50; 414/128

[58] Field of Search ..... 414/50, 114, 115, 128, 414/37; 271/84, 85, 98, 218, 189, 220, 3.1, 221, 160, 165, 166

[56] References Cited

U.S. PATENT DOCUMENTS

| | | | |
|---|---|---|---|
| 4,027,871 | 6/1977 | Niemeyer et al. | 271/165 X |
| 4,286,908 | 9/1981 | Pfäffle | 414/115 |
| 4,297,066 | 10/1981 | Ramcke et al. | 414/115 X |
| 4,406,449 | 9/1983 | Buck | 271/189 |
| 4,436,472 | 3/1984 | Kunzmann | 414/115 X |
| 4,474,093 | 10/1984 | Neubuser et al. | 414/115 X |

FOREIGN PATENT DOCUMENTS

| | | | |
|---|---|---|---|
| 71864 | 2/1983 | European Pat. Off. | 114/ |
| 2753301 | 12/1978 | Fed. Rep. of Germany | 414/114 |

*Primary Examiner*—Frank E. Werner

*Attorney, Agent, or Firm*—Wenderoth, Lind & Ponack

[57] ABSTRACT

A paper sheet manipulator has a main manipulation member, an auxiliary manipulation member and devices for moving the main and auxiliary manipulation members. The main manipulation member is adapted to temporarily receive the front edges of paper sheets being fed for the purpose of accumulating the paper sheets into a sheet unit composed of a prescribed number of accumulated paper sheets, whereas the auxiliary manipulation member is adapted to press down the sheet unit to form a sufficient gripper insertion space between the sheet unit and the temporarily received paper sheets and suppress swelling and play of the upper layer of the sheet unit, thereby eliminating the drawbacks suffered by the conventional paper takeout and supply apparatus in operating a gripper of the apparatus for taking out and supplying to the subsequent step the sheet unit.

4 Claims, 8 Drawing Figures

PAPER SHEET MANIPULATOR

BACKGROUND OF THE INVENTION

1. Field of the Invention

The present invention relates to a paper sheet manipulator adapted to be used in a paper takeout and supply apparatus which takes out a sheet unit composed of a prescribed number of accumulated paper sheets while accumulating paper sheets being fed and supplies the sheet unit to the subsequent step.

2. Description of the Prior Art

In a paper takeout and supply apparatus, paper sheets of a uniform size cut from an elongate sheet of paper are continuously fed and accumulated one on top of another, and a sheet unit composed of a prescribed number of accumulated paper sheets is taken out and supplied to the subsequent step by the use of a gripper. When the fed paper sheets are accumulated, they undergo slippage one on top of another, and the accumulated paper sheets undergo swelling because paper is liable to curl due to its formation. For this reason, the gripper has sometimes failed to precisely grip the accumulated paper sheets, thereby giving rise to damaged paper sheets, failure to take out the accumulated paper sheets and failure to supply a sheet unit composed of a prescribed number of accumulated paper sheets to the subsequent step. Further, since the height in position at which the cut paper sheets are fed to the accumulation portion has its limitations, it has been difficult to form a space sufficient for the gripper to be inserted between the aforementioned height and the uppermost paper sheet of the accumulated paper sheets.

OBJECT AND SUMMARY OF THE INVENTION

The present invention has been accomplished in order to eliminate the aforementioned drawbacks suffered by the conventional paper takeout and supply apparatus.

The principal object of the present invention is to provide a paper sheet manipulator capable of precisely forming a sufficient gripper insertion space between the upper surface of a sheet unit composed of a prescribed number of accumulated paper sheets and the lower side of continuously fed paper sheets and, at the same time, temporarily receiving the continuously fed paper sheets with precision at a fixed position above the sheet unit, whereby it is possible to continuously feed and accumulate paper sheets, take out and supply to the subsequent step the sheet unit as gripped by a gripper without hindrance and accumulate the temporarily received paper sheets.

To attain the object described above, according to the present invention, there is provided a paper sheet manipulator for use in a paper takeout and supply apparatus comprising means for continuously feeding and accumulating paper sheets of a given size and a gripper for gripping and supplying to the subsequent step a sheet unit composed of a prescribed number of accumulated paper sheets, which paper sheet manipulator is disposed above the sheet unit and comprises a pair of manipulation claws disposed so as to be movable between their manipulation position and their standby position and adapted to temporarily receive the forward ends of the paper sheets being fed above the sheet unit when the manipulation claws have moved forward to their manipulation position and, when the manipulation claws have moved backward to their standby position, to release the temporarily received paper sheets; a pair of sheet press feet disposed so as to be movable in conjunction with the manipulation claws and further movable between a sheet press position and a standby position and adapted to press down the upper surface of the front portion of the sheet unit to form between the upper surface of the sheet unit and the lower surface of the lowermost one of the paper sheets temporarily received by the manipulation claws a space for insertion of the gripper when the sheet press feet have moved down to their sheet press position and, when the sheet press feet have moved up to their standby position, to release the pressing against the sheet unit; and means for moving the manipulation claws and the paper press feet.

The aforementioned object, other objects, advantages and characteristic features of the present invention will become apparent to those skilled in the art as the disclosure is made in the following description of a preferred embodiment of the invention, as illustrated in the accompanying drawings.

DETAILED DESCRIPTION OF THE PREFERRED EMBODIMENT

The present invention will now be described with reference to the illustrated embodiment.

Figure 1:
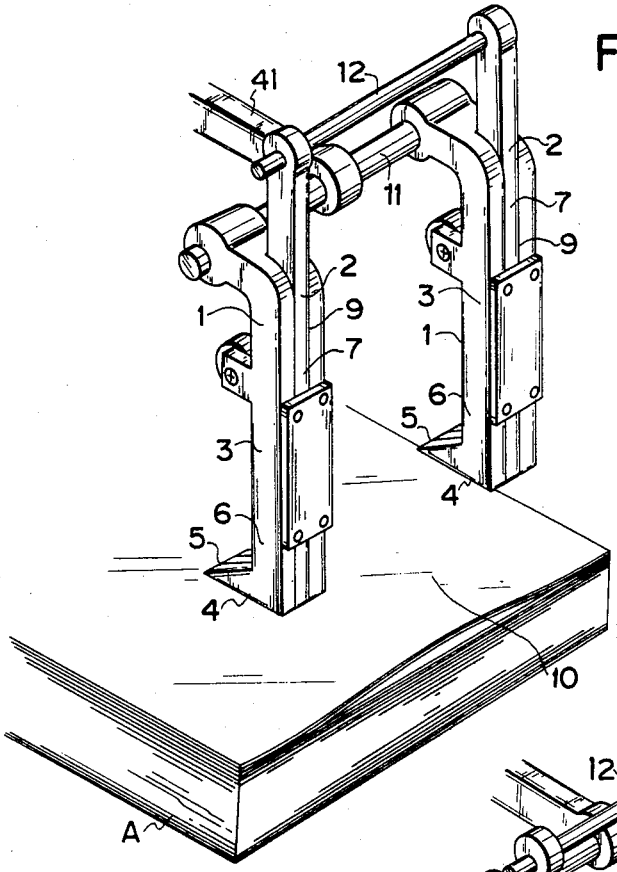
FIG. 1 is a perspective view illustrating one embodiment of a paper sheet manipulator according to the present invention, with main manipulation members at their manipulation position and auxiliary manipulation members at their standby position.
Figure 2:
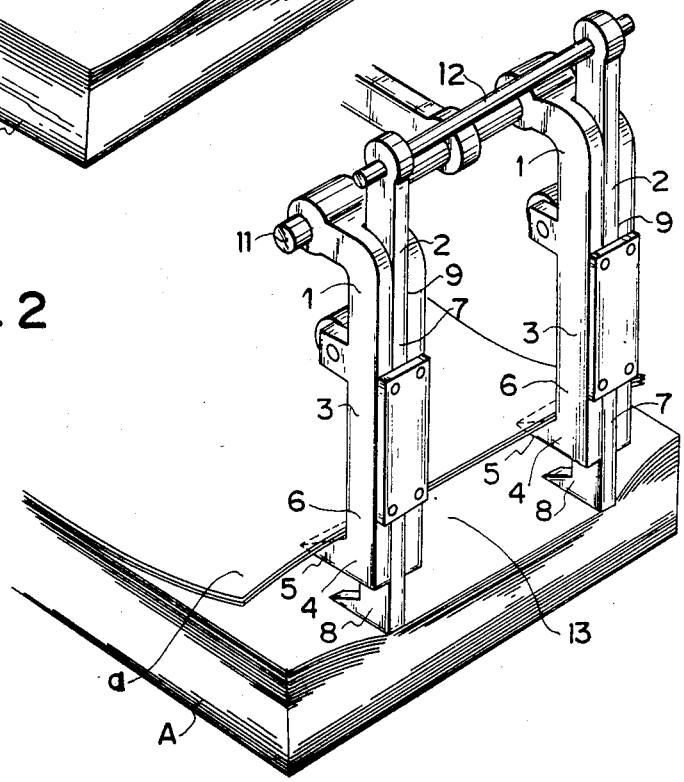
FIG. 2 is a perspective view illustrating the same embodiment, the main manipulation members at their manipulation position and the auxiliary manipulation members at their sheet press position.
Figure 3:
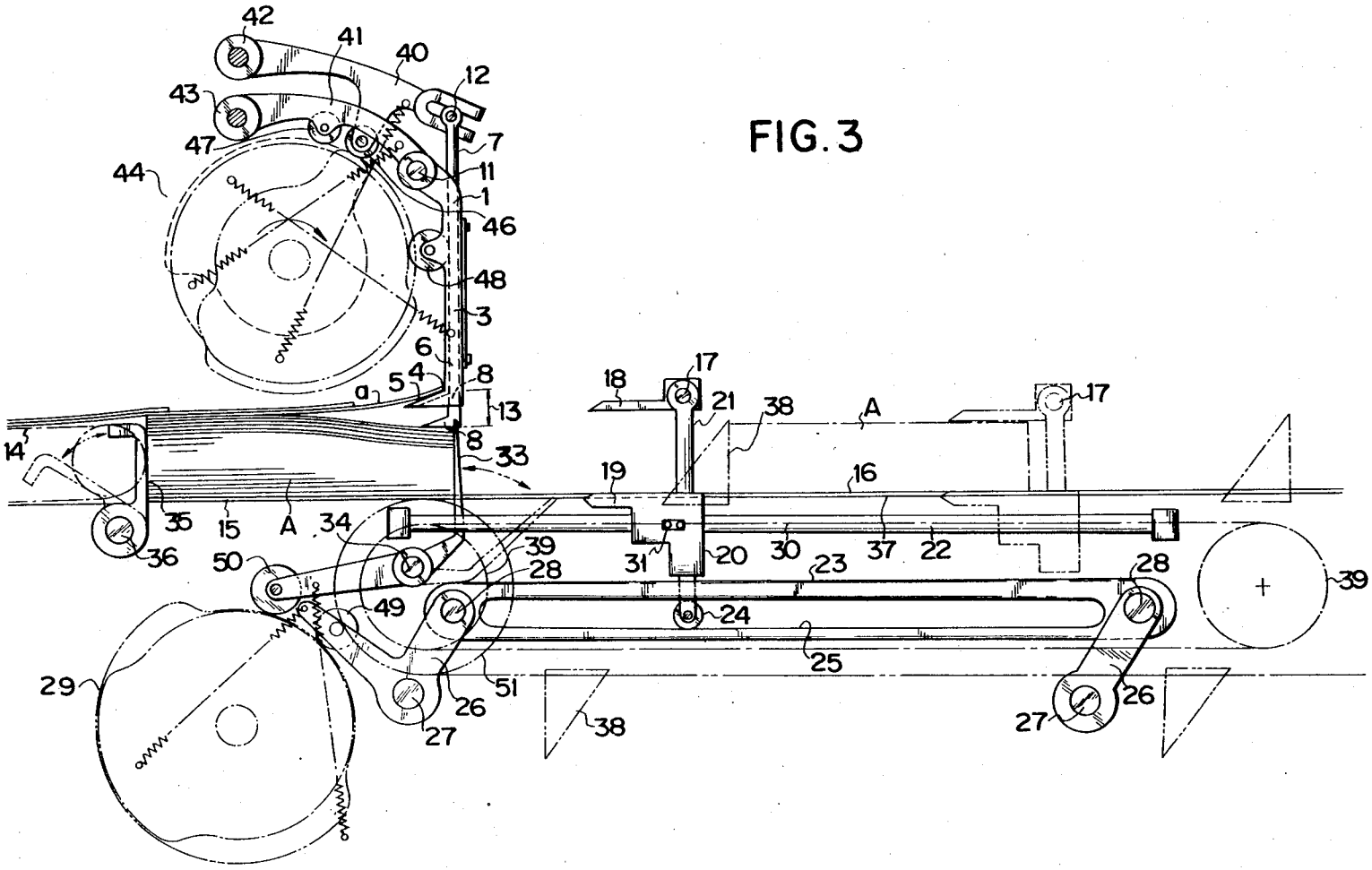
FIG. 3 is a side view illustrating the embodiment as applied to a paper takeout and supply apparatus.
Figure 4:
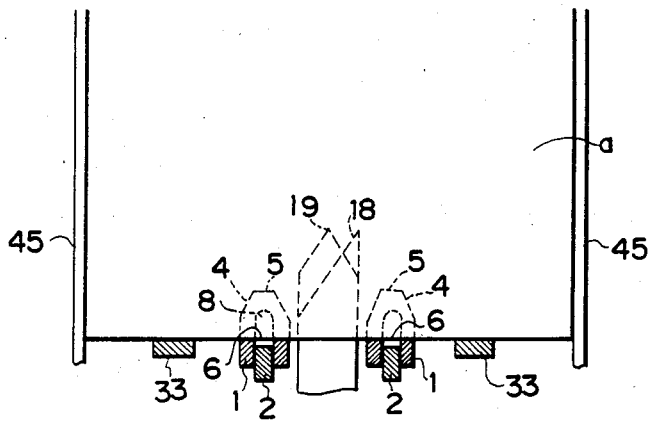
FIG. 4 is a plan view illustrating a state in which the embodiment is operated.
Figure 8:
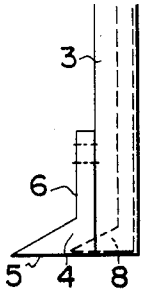
FIG. 8 is a side view illustrating a modification of the main manipulation member.

FIG. 1 and FIG. 2 illustrate one embodiment of a paper sheet manipulator according to the present invention. FIG. 3 illustrates the manipulator as used in a paper takeout and supply apparatus for a sheet unit A composed of a prescribed number of accumulated paper sheets. The paper sheet manipulator in this embodiment comprises a pair of main manipulation members 1 and a pair of auxiliary manipulation members 2, with each of the main manipulation members and the corresponding auxiliary manipulation member being a composite structure. The main manipulation member 1 is provided with a main arm 3 movable forward and rearward relative to the front edge of a paper sheet a being fed and with a manipulation claw 4 connected with the lower end of the main arm 3 movable in conjunction with the main arm 3 and adapted to temporarily receive the paper sheets being fed. The manipulation claw 4 is provided with a support piece 5 projecting from the main arm 3 toward the rear edge of the paper sheet a to support thereon the front portions of the paper sheets being continuously fed and with a butt 6 connected with the base of the support piece 5 to stop the advance of the front edges of the paper sheets. The support piece 5 and the butt 6 are in a substantially L shape arrangement. The manipulation claw 4 and the main arm 3 are formed of a single part in this embodiment. Optionally, however, they may be formed of separate parts. In this case, the manipulation claw 4 is connected to the lower end of the main arm 3 with a suitable means as shown in FIG. 8. The main manipulation members 1 are movable forward to a manipulation position and rearward to a standby position.

The auxiliary manipulation member 2 is provided with an auxiliary slide arm 7 disposed on the main arm 3 of the main manipulation member 1 so as to be slidable up and down relative to the upper surface of the front portion of the sheet unit A along the main arm 3 as a guide and is also provided with a sheet press foot 8 connected with the lower end of the slide arm 7 so as to be movable in conjunction with the slide arm 7. The auxiliary manipulation member 2 is longitudinally telescopically fitted in the main manipulation member 1 as illustrated in FIG. 2. To be specific, the main arm 3 of the main manipulation arm 1 has a longitudinal guide in the form of a groove or hole 9 formed therein, and the slide arm 7 and sheet press foot 8 of the auxiliary manipulation member 2 are inserted into the guide groove or hole 9 so as to be slidable up and down along the guide groove or hole 9 as a guide. The sheet press feet 8 are accommodated within the manipulation claws 4 when the auxiliary manipulation members 2 have been moved up to their standby position and, when the auxiliary manipulation members 2 are moved down to their paper press position, projecting downward from the manipulation claws 4 to press down and compress the sheet unit A composed of a prescribed number of accumulated paper sheets.

Figure 5:
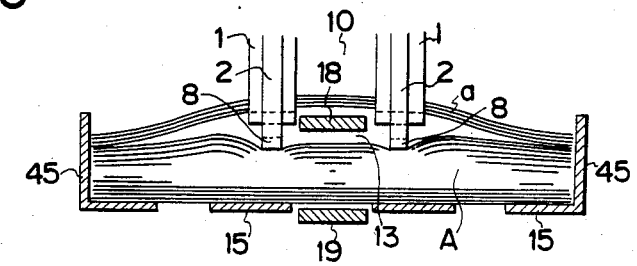
FIG. 5 is a cross section illustrating the same state.

As is best illustrated in FIG. 5, when the main manipulation members 1 are in their manipulation state and the auxiliary manipulation members 2 in their paper press state, there is formed a gripper insertion interval 10 between the main manipulation members 1 and a gripper insertion space between the upper surface of the sheet unit compressed by the auxiliary manipulation members 2 and the lower surface of the lowermost one of the fed paper sheets temporarily received by the main manipulation members 1.

It is noted that the paper sheet manipulator may comprise a single main manipulation member and a single auxiliary manipulation member, although this is not illustrated in the drawings. In this case, the main manipulation member comprises a main arm and a pair of manipulation claws, whereas the auxiliary manipulation member comprises an auxiliary arm and a pair of sheet press feet disposed sideways of the auxiliary arm at a given interval. The gripper insertion interval 10 is formed between the pair of sheet press feet in this particular embodiment. It goes without saying that the paper sheet manipulator may comprise three or more main manipulation members and three or more auxiliary manipulation members as the occasion demands.

Returning to FIGS. 1 and 2, reference numeral 11 designates a pivot shaft laterally extending between the upper ends of the main manipulation members 1, extending through the upper ends. The main manipulation members 1 are suspended from the pivot shaft 11 and swung forward and rearward with the pivot shaft 11 as a fulcrum. The upper ends of the auxiliary manipulation members 2 project upward from the guide grooves or holes 9 of the main manipulation members 1, and a pivot shaft 12 parallel to the pivot shaft 11 for the main manipulation members 1 extends through the projected upper ends of the auxiliary manipulation members 2. Thus, the auxiliary manipulation members 2 are suspended from the pivot shaft 12, swung with the pivot shaft 12 as a fulcrum in conjunction with the swing of the main manipulation members 1, and independently slid up and down within the slide grooves or holes 9 in the main manipulation members 1 while suspended from the pivot shaft 12 by applying ascending and descending forces to the pivot shaft 12. Similarly, the main manipulation members 1 may be moved up and down by applying ascending and descending forces to the pivot shaft 11 so that they can function to slightly lift the fed paper sheets temporarily received by the manipulation claws 4. The aforementioned movement of the main and auxiliary manipulation members can be produced by any suitable means, such as a cam mechanism, described hereinafter.

FIG. 3 illustrates an apparatus for taking out and supplying to the subsequent step the sheet unit A composed of a prescribed number of accumulated paper sheets, in which the aforementioned paper sheet manipulator moved by a cam mechanism 44 has been used.

The paper sheets a of a given size cut from an elongate sheet of paper are continuously fed on a conveyor 14 and accumulated on a support plate 15. There is provided a known detector (not shown) for detecting the passage of the fed paper sheets a to confirm that the accumulated paper sheets have been fed so as to complete the sheet unit A. Therefore, the paper sheet manipulator and a gripper 17 can be moved in good time as soon as the detector has detected the completion of the sheet unit A of a prescribed number of accumulated sheets.

On the front edge of the support plate 15 there is disposed a front regulation member 33 which swingably rises and falls down around a pivot pin 34 as a fulcrum for aligning the front edges of the paper sheets being accumulated on the support plate 15 when member 15 is in its upright position and, at its non-interference downward position as illustrated by the phantom line in FIG. 3, permitting takeout of the sheet unit A made up of a prescribed number of paper sheets. The movement of the front regulation member 33 is obtained by means such as a cam mechanism 29 as illustrated in FIG. 3 wherein reference numeral 50 denotes a roller which rolls along the cam surface of a peripheral cam ring and transmits its movement to the front regulation member 33. On the rear edge of the support plate 15 there is disposed a rear regulation member 35 which is swingable about a pivot pin 36 and taps the paper sheets on the rear edges during the course of the sheet accumulation to align the front edges of the paper sheets along the front regulation member 33. On the opposite side edges of the support plate 15 there are disposed side ruler plates 45 for regulating the side edges of the paper sheets being accumulated as shown in FIG. 5. Thus, the support plate 15, front regulation member 33, rear regulation member 35 and side ruler plates 45 define a paper sheet accommodation space and align the front, rear and opposite side edges of the paper sheets being accumulated.

A sheet unit guide plate 16 flush with the support plate 15 extends in the forward direction of the support plate 15, and a rod rail 22 is laterally positioned parallel to the guide plate 16. The gripper 17 comprises upper and lower gripper members 18 and 19 directed toward the accumulated paper sheets, a slider 20 formed integrally with the lower gripper member 19 and mounted on the rail 22 so as to be laterally slidable along the rail 22, and a support post 21 extending vertically from the upper gripper member 18 and inserted into the slider 20 so as to be longitudinally slidable therein, whereby the upper and lower gripper members 18 and 19 can be reciprocated forward and rearward with the rail 22 as a guide and the upper gripper member 18 can be moved up and down in conjunction with the longitudinal movement of the support post 21 to vary the distance for gripping the sheet unit A between the upper and lower gripper members.

The gripper 17 is reciprocated forward and rearward by a reciprocation mechanism comprising wheels 39 and an endless chain 30 which extends between the wheels 39 in parallel to the rail 22 and has its running portion connected to the slider 20 by a joint portion as shown in FIG. 3. The chain 30 is reciprocated by the drive of the wheels 39 in the normal and reverse directions. The gripper 17 retracts parallel to the guide plate 16 by the running movement of the chain 30 and advances parallel to the guide plate 16 by the returning movement of the chain. The variation in distance between the upper and lower gripper members 18 and 19 of the gripper 17 is obtained by a shift mechanism which comprises a cam lever 23 disposed parallel to the rail 22 and provided in the direction of its length with a grooved rail 25 in which a roller 24 attached to the lower end of the support post 21 of the gripper 17 is fitted so as to be rollable therealong, cranks 25 pivotally attached to the opposite ends of the cam lever 23 by means of pivot shafts 28 for being swung about different pivot shafts 27, and a roller 49 rollable along the cam surface of the peripheral cam ring of the aforementioned cam mechanism 29 to transmit its movement to the cranks 26 and cam lever 23. Thus, the cam lever 23 is shifted in parallel by means of the cranks 26 and, accompanying the shift of the cam lever, the support post 21 and the upper gripper member 18 are moved up and down. The gripper 17 grips and takes out the sheet unit A by the composite movement of the movement for variation in distance between the upper and lower gripper members 18 and 19 based on the movement of the cam lever 23 and its own reciprocation.

The paper sheet manipulator of the present invention forms the aforementioned gripper insertion space 13 between the sheet unit A and the paper sheet a by cooperation of the main and auxiliary manipulation members 1 and 2 when the sheet unit A is subjected to takeout treatment by means of the gripper 17. The main manipulation member 1 is advanced to its manipulation position which is hereinafter referred to as its reception position at which the fed paper sheets are temporarily received and is retracted to its standby position at which the temporary reception of the sheets is released. The main manipulation member 1 accompanying the auxiliary manipulation member 2 is advanced immediately to its reception position when the accumulated paper sheets have reached the prescribed number, i.e. when the sheet unit A has been formed, and thereafter when the sheet unit A has been gripped and taken out by the gripper 17, retracted immediately to its standby position. The reciprocation of the main manipulation member 1 between its reception position and its standby position can be obtained by providing the main arm 3 of the main manipulation member 1 with a roller 48 which rolls along the cam surface of the peripheral cam ring of the cam mechanism 44, for example, as shown in FIG. 3.

Figure 6:
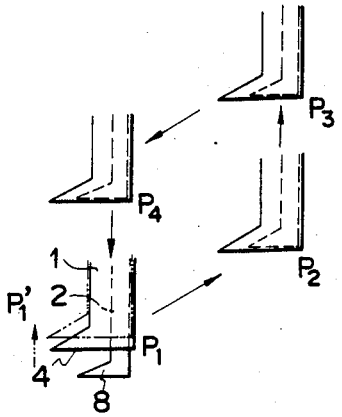
FIG. 6 is a side view illustrating one example of movement of the embodiment.
Figure 7:
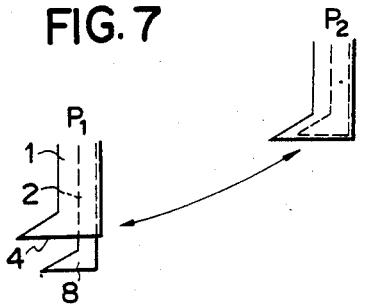
FIG. 7 is a side view illustrating another example of movement of the embodiment.

The movement of the main manipulation member 1 is shown in FIG. 6 or FIG. 7, for example. In the case of FIG. 6, the main manipulation member 1 disposed at its reception position $P_1$ is retracted to a position $P_2$, moved up to a position $P_3$, advanced to a position $P_4$ and moved down back to the reception position $P_1$, describing a quadrilateral. The positions $P_2$ or $P_3$ are regarded as the aforementioned standby position. In the case of FIG. 7, the main manipulation member 1 is swung between its reception position $P_1$ and its standby position $P_2$. In either case, the main manipulation member 1 is constructed such that it can ascend slightly from the reception position $P_1$ to a position $P_1'$ to lift the front edges of the paper sheets a received by the main manipulation member 1 as illustrated in FIG. 6. This slight ascent of the main manipulation member 1 can be obtained by pivotally supporting the pivot shaft 11 for suspending the main manipulation member 1 therefrom on a suspension lever 41 which is swingable around a pivot shaft 43 and causing a roller 47 mounted on the suspension lever 41 to roll along the cam surface of the peripheral cam ring of the cam mechanism 44 as illustrated in FIG. 3.

The main manipulation member 1 is brought to its reception position and the manipulation claws 4 start to temporarily receive the paper sheets a being fed. To be specific, the butts 6 of the manipulation claws 4 receive the front edges of the paper sheets a being fed to stop the advance of the paper sheets a and, at the same time, the support pieces 5 of the manipulation claws 4 support thereon the lower surface in the vicinity of the front edge of the lowermost one of the paper sheets a being continuously fed. Accompanying the aforementioned temporary reception, the auxiliary manipulation member 2 is caused to descend, thereby projecting downward from the manipulation claws 4 the sheet press feet 8 accommodated within the main manipulation member 1. As a result, the sheet press feet 8 press and compress the upper surface in the vicinity of the front edge of the sheet unit A composed of a prescribed number of accumulated paper sheets and disposed immediately below the paper press feet 8 to form the gripper insertion space 13. The ascent and descent of the auxiliary manipulation member 2 can be obtained means such as the cam mechanism 44 shown in FIG. 3, i.e. by pivotally connecting a suspension lever 40 to the pivot shaft 12 for suspending the auxiliary manipulation member 2 therefrom and causing a roller 46 mounted on the suspension lever 40 to roll along the cam surface of the peripheral cam ring of the cam mechanism 44, thereby swinging the suspension lever 40 around a pivot shaft 42.

After the formation of the gripper insertion space 13, the aforementioned gripper 17 is moved forward by the reciprocation mechanism in conjunction with the aforementioned shift mechanism to cause the upper gripper member 18 to be inserted into the gripper insertion space 13 and to cause the lower gripper member 19 to be applied to the lower surface of the sheet unit A. The front edge of the sheet unit A is then gripped between the upper and lower gripper members by lowering the upper gripper member 18. Subsequently, the auxiliary manipulation member 2 is caused to ascend to the standby position $P_2$, thereby releasing the pressing against the sheet unit A, and the front regulation member 33 is caused to fall down below the guide plate 16.

After the pressing by the auxiliary manipulation member 2 and the regulation by the front regulation member 33 have been released, the gripper 17 retracts while gripping the sheet unit A and takes out the sheet unit A onto the guide plate 16. After the rear end of the sheet unit A has been completely taken out onto the guide plate 16, the upper gripper member 18 is caused to ascend to release the gripping of the sheet unit and, in synchronism with this release, a pusher 38 is brought to the rear portion of the sheet unit and pushes the sheet unit on the guide plate 16 forwardly and supplies it to the subsequent step.

The support post 21 of the gripper 17 is disposed laterally of the guide plate 16 and has a bar on the upper end thereof extending across the width of the guide plate 16 with a space left between the bar and the guide plate, and the upper gripper member 18 is mounted on the bar. With this arrangement, the sheet unit A pushed by the pusher 38 does not interfere with the gripper 17. In FIG. 3, reference numeral 37 denotes a pusher actuating chain disposed to run parallel to the guide plate 16 and reference numeral 51 designates a chain wheel.

A series of operations for feeding and accumulating the paper sheets a and taking out the sheet unit A can be carried out continuously by the use of the paper sheet manipulator of the present invention.

According to the present invention providing a paper sheet manipulator of composite structure of main and auxiliary manipulation members, as described above, it is possible to form between a sheet unit having a prescribed number of accumulated paper sheets and paper sheets continuously fed a gripper insertion space large enough to precisely admit insertion of a gripper, to temporarily receive the continuously fed paper sheets precisely at a fixed position above the formed sheet unit, and to take out the sheet unit by the gripper in cooperation with the main and auxiliary manipulation members. In addition to the aforementioned capability of forming a sufficient gripper insertion space by the synergistic action of the main and auxiliary manipulation members, the paper sheet manipulator of the present invention makes it possible to precisely suppress swelling and play of the upper layer portion of the sheet unit and prevent the gripper from failing to precisely grip the sheet unit to thereby eliminate occurrence of damaged paper sheets, failure to take out the sheet unit and failure to supply the sheet unit composed of a prescribed number of accumulated paper sheets to the subsequent step.

Further, in the present invention, since the gripper insertion space is increased in size by compressing the sheet unit with the auxiliary manipulation member, ascent of the main manipulation member for lifting the paper sheets being received is not required or will suffice if the amount thereof falls within a small limitation, with the result that a fear of the fed paper sheets slipping down, which may possibly be experienced in lifting the front edges of the fed paper sheets to a higher position so as to form a larger gripper insertion space, can be eliminated. In the present invention, the paper sheets being fed can be temporarily received with precision during the course of taking out the sheet unit and then the temporarily received paper sheets can be brought to a position for sheet reaccumulation.

What is claimed is:

1. A paper sheet manipulator for use in a paper take-out and supply apparatus having means for continuously feeding paper sheets of a given size, means for accumulating delivered paper sheets until a prescribed number of paper sheets have been accumulated into a sheet unit, and a gripper for gripping the sheet unit and supplying the unit to a subsequent step, the paper sheet manipulator comprising:

a pair of main manipulation members disposed above said accumulating means and each comprising a main arm having a manipulating claw on the lower end thereof, said arm being movable between a manipulation position in which the manipulating claw thereon is positioned above the top sheet in the accumulating means for temporarily receiving the forward ends of paper sheets fed into the accumulating means above the sheet unit already accumulated therein, and a release position in which said manipulating claw is shifted laterally of the accumulating means for releasing the temporarily received paper sheets for dropping them into the accumulating means;

a pair of auxiliary manipulation members each comprising an auxiliary arm having a sheet pressing foot on the lower end thereof and movably mounted on a corresponding main arm of said main manipulation member for movement with the main arm and movement relative to the main arm up and down between a paper press position in which the sheet press foot is pressed down against the upper surface of the end of the sheet unit which is toward the gripper for forming between the upper surface of the sheet unit and the lower surface of the lowermost paper sheet temporarily received by said manipulating claw a space for permitting insertion of the gripper, and a raised position in which said auxiliary arm is raised away from the paper press position; and means for moving said main manipulating members from the release position to the manipulation position when the last sheet of the sheet unit is delivered to the accumulating means, and after the manipulating members have been moved, moving said auxiliary manipulation members from the raised position to the paper pressing position for forming said space.

2. A paper sheet manipulator as claimed in claim 1 in which each of said main manipulation members has a guide therein extending in the vertical direction thereof, each of said auxiliary manipulation members is slidably fitted in a corresponding guide, and each of said manipulating claws has a recess in the bottom thereof and said sheet press feet are accommodated within said recesses when they are in the raised positions, and project downwardly therefrom in the paper pressing position.

3. A paper sheet manipulator as claimed in claim 1 in which said manipulating claws each has a support piece projecting from the main arm thereof toward the rear edge of the paper sheets being fed thereon, and a butt connected with the base of the support piece to stop the advance of the front edges of the paper sheets.

4. A paper sheet manipulatory as claimed in claim 1 in which said moving means is a cam mechanism.

* * * * *